US005277349A

United States Patent [19]

Rowe

[11] Patent Number: 5,277,349

[45] Date of Patent: Jan. 11, 1994

[54] COMBINATION BACKPACK AND TENT

[76] Inventor: Ken Rowe, 18438 N. 46th Dr., Glendale, Ariz. 85308

[21] Appl. No.: 941,907

[22] Filed: Sep. 8, 1992

[51] Int. Cl.[5] ..... A45F 4/04

[52] U.S. Cl. ..... 224/154; 224/151; 135/96

[58] Field of Search ..... 224/154, 151, 153, 209, 224/210, 211, 212, 213, 214; 135/96, 95, 90, 87

[56] References Cited

U.S. PATENT DOCUMENTS

| | | | |
|---|---|---|---|
| 3,822,813 | 7/1974 | Carter | 224/154 |
| 3,912,138 | 10/1975 | Pava | 224/154 |
| 3,923,217 | 12/1975 | Dean et al. | 224/153 |
| 3,931,918 | 1/1976 | Smith et al. | 224/154 |
| 3,971,495 | 7/1976 | Velazquez | 224/154 |
| 4,418,854 | 12/1983 | Genovese | 224/154 |
| 4,885,812 | 12/1989 | Lindner | 224/154 |

FOREIGN PATENT DOCUMENTS

| | | | |
|---|---|---|---|
| 0031860 | 7/1981 | France | 224/154 |
| 1581786 | 12/1980 | United Kingdom | 135/96 |

*Primary Examiner*—Henry J. Recla

*Assistant Examiner*—David J. Walczak

*Attorney, Agent, or Firm*—LaValle D. Ptak

[57] ABSTRACT

A combination backpack and tent system utilizes the backpack frame as the support for one end of a tent. This frame has a pair of tent leg holding members attached to the upper end of the frame on each side. The tent is secured to the lower end of the backpack frame; so that it can be rolled up and stored on the frame, covered by a short flap constituting an extension of the floor. This flap is rolled over the tent and secured to the frame. When the tent is erected, the short flap is pulled to the opposite side of the backpack frame and the tent is unrolled. The tent extends up over a pack on the backpack at one end, and telescoping legs or flexible tent pole extensions are attached to the leg holding members on each side of the backpack. The tent is extended; and when it is erected, the pack portion of the backpack faces the interior of the tent. A pair of flaps extend from the sides of the tent over the opposite side of the backpack, and are secured together to form a substantially weather-tight system. The pack portion of the backpack is located inside the tent for access to the contents thereof from within the tent.

19 Claims, 2 Drawing Sheets

FIG. 5
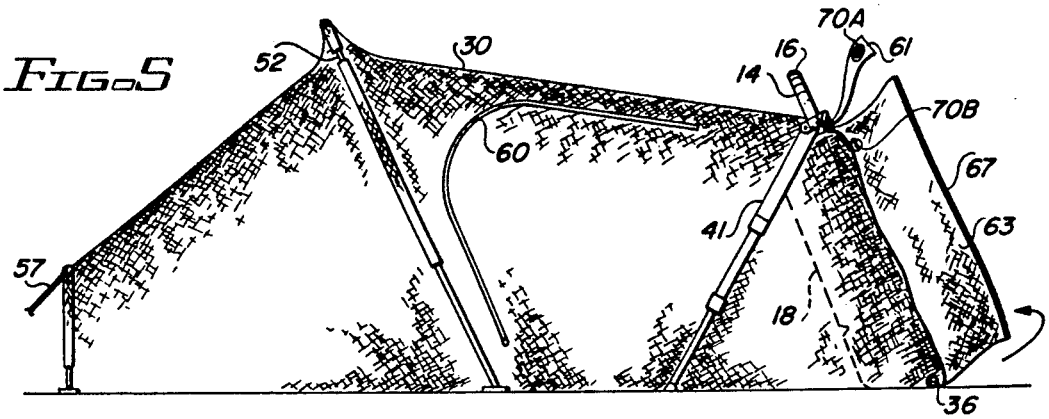
FIG. 6
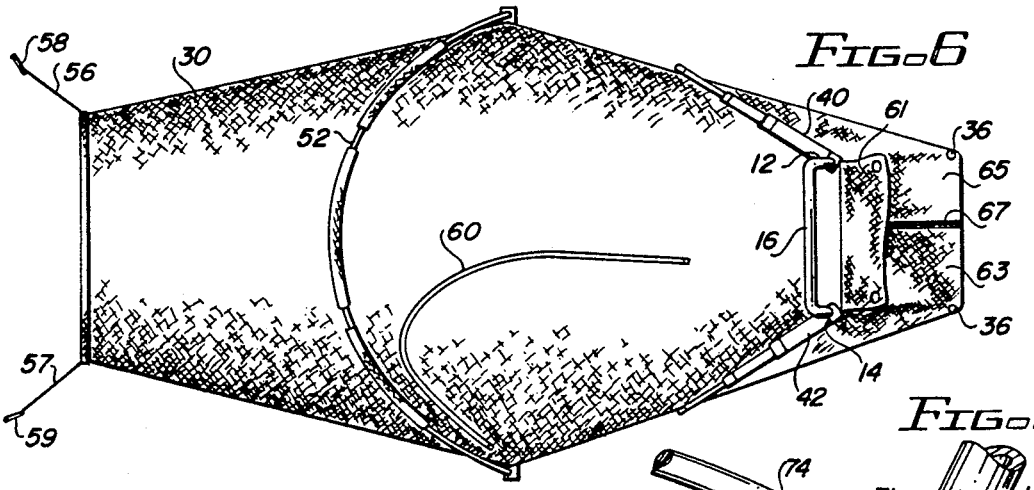
FIG. 9
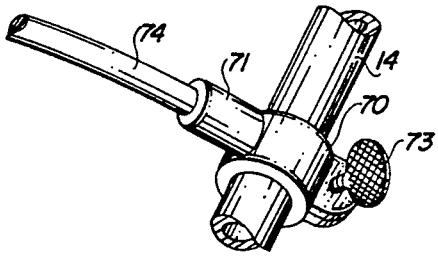
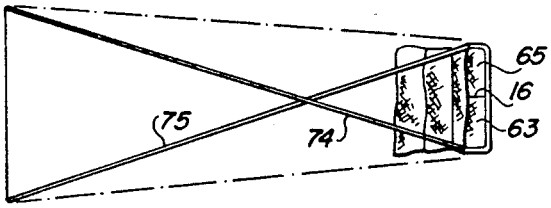
FIG. 8
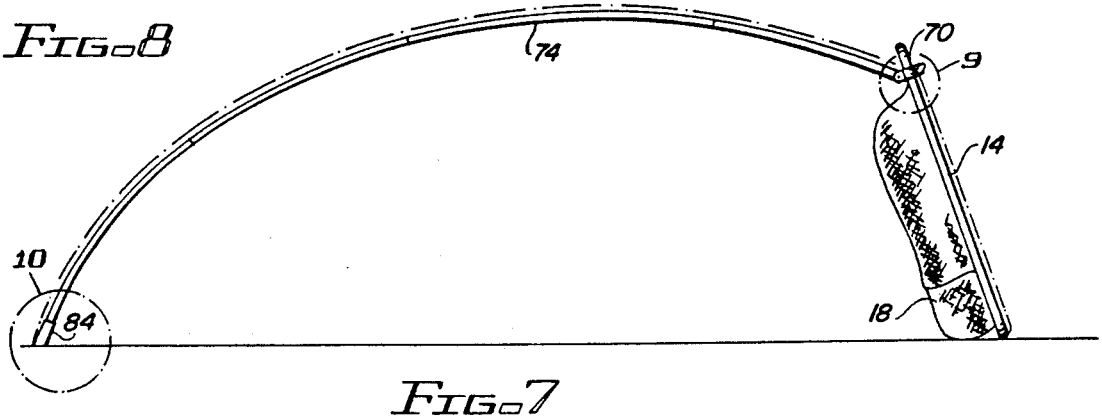
FIG. 7

COMBINATION BACKPACK AND TENT

BACKGROUND

Outdoorsmen, such as hikers, hunters, mountain climbers and the like typically carry all of the necessary camping equipment with them on a backpack frame. Backpack frames usually are made of lightweight metal, such as tubular aluminum or the like, in the form of a generally vertical frame having a pair of spaced-apart vertical side members which are interconnected at the top and at intermediate points by cross members. The frame has shoulder straps and a hip belt for distributing the weight of items carried on the frame comfortably on the hiker using the backpack.

Generally, a pack made of nylon or other suitable material is attached to the frame. Such packs usually have a large central compartment with a flap-covered opening at the top. Frequently, there are one or more side pockets on each side of the central pack, which are separately accessible, and the exterior of the main body portion of the pack often has one or more smaller pockets located on its exterior surface. This permits different items to be carried in the various pockets and portions of the pack; so that they may easily be separately accessed. Usually, such frames have a space at the top, above the pack, to which a lightweight tent or sleeping bag may be attached, and a similar space below the main pack, again, to which either a sleeping bag or a lightweight tent may be attached.

Tents typically carried by backpackers are made of lightweight material, such as nylon, and typically include sectionalized poles, usually made of flexible fiberglass, for supporting the tent in its erected position. When this is done, the backpack either then must be placed separately inside the tent, if that is the desire of the hiker, of it is left outside the tent. During rainy weather, or when marauding animals are likely to be encountered, it generally is not advisable to leave the backpack outside; so that it must be placed inside the tent. When this is done inside a standard tent, the backpack takes up space that otherwise is used by the tent occupants, and it is cumbersome to move the backpack into and out of the tent.

In the past, specialized backpack frames have been designed for providing a carrying frame when the backpacker is hiking, which is utilized to provide a frame for a cot or a tent. Three patents directed to devices of this type are the patents to Smith et al. U.S. Pat. No. 3,931,918; Velazquez U.S. Pat No. 3,971,495; and Lindner U.S. Pat. No. 4,885,812. The devices disclosed in all three of these patents require a specialized construction of the backpack or backpack frame in order to provide the tent (or cot) capability. None of the devices disclosed in these patents are adaptable to a standard backpack; and most of the bulk of the device is directly employed for the storage of the frame members and the tent or cot material. None of them have any provision for making the contents of the parts of the backpack, which are not used directly in constructing a tent, accessible from within such a tent.

A patent directed to another type of combination backpack frame and tent is the patent to Carter U.S. Pat. No. 3,822,813. This patent discloses a backpack frame which has telescoping and pivoting members to extend it to a length sufficient to overlie a sleeping bag placed underneath it. In the extended form, the frame is used to suspend a tent attached beneath it. Both ends of the frame need to be attached to some upright support to hold it up above the sleeping bag located within the tent. Once again, a standard backpack frame is not used; and there is no provision for making the pockets of the pack of a standard backpack accessible from within the tent.

Two other patents are specifically directed to backpack frames which are disassembled to provide a number of component parts for re-assembly into a tent frame. These are the patents to Pava No. U.S. Pat. No. 3,912,138 and Dean et al. U.S. Pat. No. 3,923,217. These devices do not employ standard backpack frames. In addition, the backpack contents, which normally are attached to a backpack frame, must be completely removed from the frame, which is disassembled and then re-assembled to form the tent frame.

It is desirable to provide a combination backpack and tent system which can be used with a conventional backpack without requiring modification of the backpack itself, and which, when assembled, encloses the backpack within the tent in such a way that the contents of the pack itself are accessible from within the tent.

SUMMARY OF THE INVENTION

It is an object of this invention to provide an improved combination backpack and tent.

It is another object of this invention to provide an improved backpack/tent combination, which does not require modification of the backpack frame.

It is an additional object of this invention to provide an improved backpack/tent combination, which encloses the backpack within the tent when it is erected, and which makes the contents of the pack portion of the backpack available to persons inside the tent.

It is a further object of this invention to provide a backpack/tent combination in which the backpack frame constitutes the support for one end of the tent, and which requires the addition of a minimum number of parts to be attached to the backpack for facilitating the carrying, storing and erection of the tent.

In accordance with a preferred embodiment of the invention, a backpack and tent system employs a rigid backpack frame having an upper end and a lower end, with first and second spaced-apart side members for carrying a pack. First and second tent leg holding members are attached, respectively, near the upper ends of the first and second side members of the backpack for supporting tent leg extensions. A tent member has a portion attached to the lower end of the backpack frame; so that it can be rolled up and stored and carried on the backpack frame. The tent member has first and second end flaps which extend around the backpack frame and enclose the frame and backpack within the tent when the tent is erected. These end flaps are releaseably secured together to do this; and when tent legs are extended from the first and second tent leg holding members, the backpack frame, in cooperation with the tent legs, serves as a support for one end of the tent.

BRIEF DESCRIPTION OF THE DRAWINGS

FIG. 5 is a side view from the opposite side to the one shown in FIG. 4 illustrating the erected configuration of the tent;

FIG. 6 is a top view of erected backpack/tent of FIG. 5;

FIG. 7 is a diagrammatic representation of an alternative embodiment of the invention;

FIG. 8 is a diagrammatic top view of the embodiment shown in FIG. 7;

FIG. 9 is a detail of the circled portion "9" of FIG. 7; and

DETAILED DESCRIPTION

Figure 1:
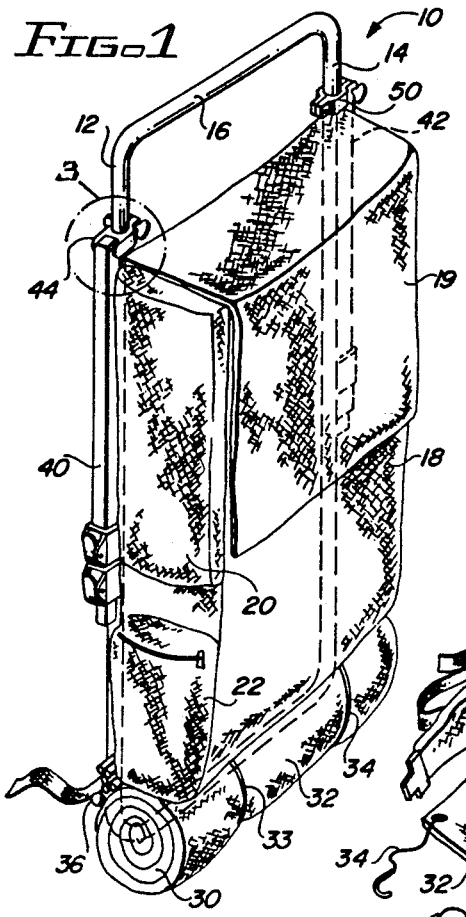
FIG. 1 is a front perspective view of a backpack incorporating a preferred embodiment of the invention.
Figure 2:
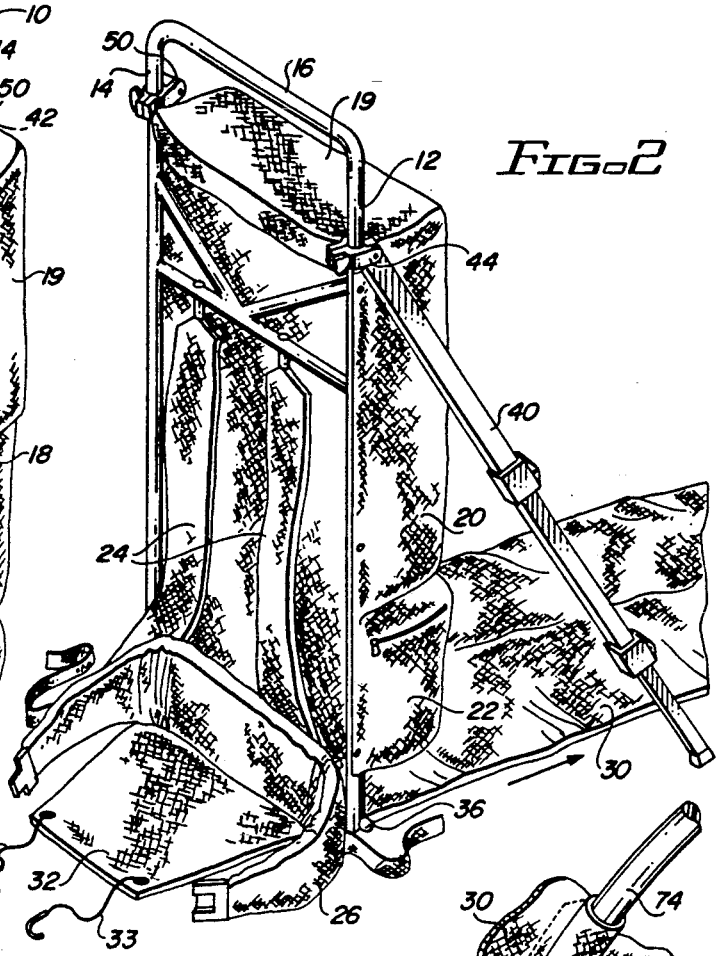
FIG. 2 is a rear perspective view of the embodiment of FIG. 1.
Figure 10:
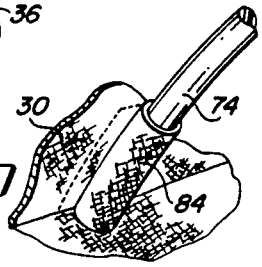
FIG. 10 is a detail of the circled portion "10" of FIG. 7.

Reference now should be made to the drawings, in which the same reference numbers are used throughout the different figures to designate the same components. FIGS. 1 and 2 show a typical backpack frame and pack 10 of the type which is commonly used by hikers and hunters As illustrated in FIG. 10, the backpack includes a frame having a pair of spaced-apart, parallel side members 12 and 14 interconnected at the top by a substantially horizontal member 16. The frame has a pack 18 attached to it by standard means The pack 18 has a main central compartment closed by an elongated flap 19; and, as illustrated in FIGS. 1 and 2, a pair of upper and lower side pockets 20 and 22 are located on each side of the pack 18. These side pockets 20 and 22 typically are accessible through zippered openings or the like at their tops; so that articles placed in these pockets can be accessed without requiring the main flap 19 to be opened.

As illustrated most clearly in FIG. 2, the backpack frame also includes additional cross support members for attaching a pair of shoulder straps 24 and a hip belt 26 to it. The structure, which has been described thus far, is commonly used in configurations which are substantially similar to the one shown in FIGS. 1 and 2. Normally, as described previously, a tent or sleeping bag is attached by means of releasable fasteners beneath the pack 18 or above the pack 18 in the space between the top of the pack where the flap 19 closes it, and the upper edge or upper part of the frame comprised by the horizontal member 16.

In the embodiment of the invention illustrated in FIGS. 1 and 2, the region below the pack 18 has a tent 30 secured to it at one end on each side of the lower part of the backpack side frame members 12 and 14 by means of a rivet 36 or other suitable fastener. The tent 30 then is rolled up, as shown in FIG. 1. A flap 32, which is an extension of the bottom of the tent and is attached at the rivets 36 to the side members 12 and 14, is rolled over the tent and secured in place by means of flexible elastic cords 33 and 34, or the like. In place of flexible cords, straps with suitable fasteners on them could be employed; so that the tent 30 is secured in a rolled-up manner at the bottom of the backpack frame, as illustrated in FIG. 1.

Figure 3:
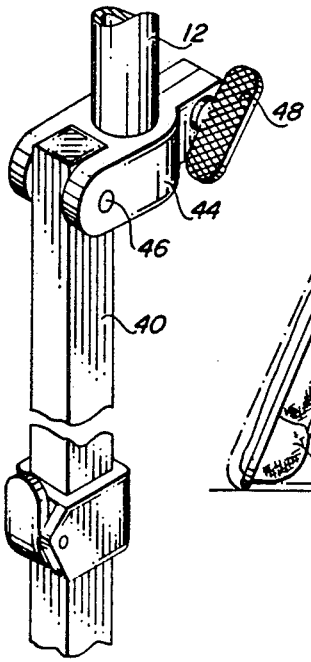
FIG. 3 is a detail of the circled portion "3" of FIG. 1.

Also, as illustrated in FIG. 1, a pair of telescoping legs 40 and 42 are secured at the upper ends thereof to pivoted swivel holding members 44 and 50, which in turn are attached near the upper ends of the side members 12 and 14 of the backpack. The member 44 is shown in enlarged detail in FIG. 3; and it is secured to the leg 12 (and the member 50 is secured to the leg 14 in a similar manner) by means of a pivotal clamp, which is tightened onto the leg 12 by means of a thumbscrew 48. The leg 40 is attached to a horizontal pivot 46 and extends downwardly from the holding member 44; so that it overlies the side member 12 of the backpack, as shown in FIG. 1. The leg 40 either can be releaseably secured to the leg 12 or the pivot 46 may be made with sufficient friction to hold the leg 40 in place, as illustrated in FIG. 1. This is the configuration of the backpack/tent combination when it is in the storage or carrying position for the hiker desiring to use the invention. It is readily apparent from an examination of FIG. 1 that very little has been added to the backpack 10 by way of extra parts or weight. The tent 30 is essentially of the same size and weight as a standard backpack tent. The legs 40 and 42 are made of lightweight material, such as hollow aluminum tubes or the like, and add a minimum amount of weight to the backpack. In addition, it is readily apparent from an examination of FIG. 1, that the legs 40 and 42 in no way impair the normal use of the backpack by the hiker using it.

Figure 4:
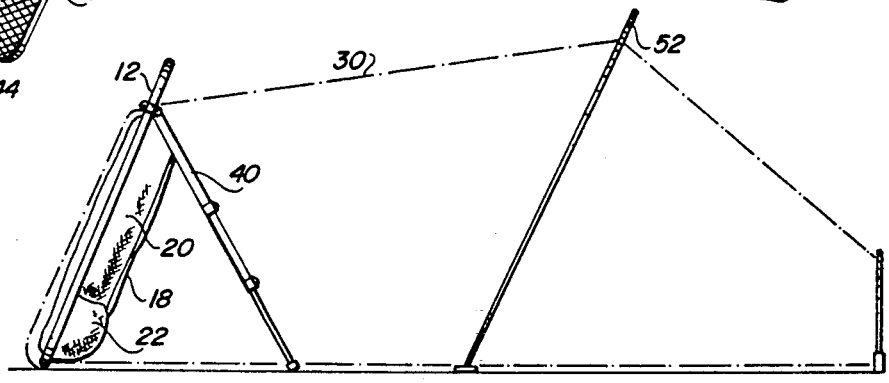
FIG. 4 is a diagrammatic outline representation of the preferred embodiment of the invention with the tent erected.

When the hiker desires to set up camp for the night, the pack is set on the ground in the position shown in FIG. 2. The telescoping legs 40 and 42 then are extended to cause their lower extensions to assume the position generally shown in FIGS. 2 and 4. They are pivoted outwardly slightly from the backpack, and they extend in the direction of the pack side 18 of the backpack frame combination The straps 33 and 34 are released, and the flap 32 is pulled out to the position shown in FIG. 2. The rest of the tent then is unrolled in the direction of the arrow shown in FIG. 2 between the legs 40 and 42 in their extended position.

The tent 30 is constructed with an opening at the end adjacent the backpack, and it extends upwardly over the top of the flap 19 against the first and second side members 12 and 14. A flap 61 is attached to this edge of the upper part of the tent and is pulled outwardly, as shown in FIGS. 5 and 6, beneath the bar 16 to extend over the backpack frame on the side where the shoulder straps 24 are located. A pair of end flaps 63 and 65 also are attached by the rivets 36 to the bottom of the opposite sides of the assembly. These flaps 63 and 65 are pulled outwardly to enclose the back of the backpack frame, which includes shoulder straps 24 and the hip harness 26 illustrated in FIG. 2. These items are placed behind the flaps 63 and 65, which have a zipper closure 67 or other suitable closure along the edges. When the two flaps 63 and 65 are secured together, as shown in FIG. 6 they completely enclose the rear side of the backpack when the tent is assembled.

The flap 32 is folded upwardly, and may be tucked behind the shoulder straps 24 when the side flaps 63 and 65 are folded over the rear of the backpack frame and secured together by the fastener 67. In this manner, all of the tent components are located within the tent; and the erected backpack/tent is secure and substantially weatherproof.

The flap 61 then is pulled outwardly over the top edge of the flaps 63 and 65 and may be held in place by means of suitable mating fasteners 70A and 70B. The fasteners 70A and 70B may be, for example, hook and loop fabric fasteners such as Velcro. or the like It is readily apparent from an examination of FIGS. 5 and that when this is done, the backpack is completely enclosed within the end of the tent 30; so that the pockets 18, 20 and 22 are accessible from within the tent. In addition, the backpack frame 12, 14, 16, itself, in conjunction with the telescoping legs 40 and 42 securely holds the end of the tent in a vertical position without the need for any ropes, tent stakes and the like. It should be noted that the legs 40 and 42 remain outside the backpack/tent assembly at all times.

A flexible, sectionalized fiberglass pole 52 inserted through appropriate loops in the tent 30 holds up the mid portion of the tent. The opposite end then may be staked to the ground by means of ropes 56 and 57 and stakes 58 and 59. The tent illustrated in FIGS. 5 and 6 includes a zippered opening 60 in its side for permitting entrance and egress. The particular location of the opening 60 and its configuration is not important, since the tent also could be accessed from the end opposite the backpack, if desired. It is important to note, however, that the backpack frame constitutes a major portion of the support for the tent, and that no modification whatsoever of the pack 18 carried on the backpack frame is necessary. In addition, the pack 18 is totally accessible from within the tent; and the backpack is fully protected by the manner in which the tent completely encloses the backpack.

FIGS. 7, 8, 9 and 10 illustrate an alternative embodiment of the invention. The backpack shown in FIGS. 1 and 2 is used; but instead of the tent leg holding members 44 and 50, along with the telescoping legs 40 and 42, a tent holding member 70 (shown most clearly in FIG. 9) is attached near the upper end of each of the side members 12 and 14 of the backpack. The holding members 70 are secured to the side members 12 and 14 by means of a thumbscrew 73, much in the same manner as the thumbscrew 48 is used to secure the members 44 and 50 to the respective side members 12 and 14 of the embodiment shown in FIGS. 1, 2 and 3.

No leg extension, such as the legs 40 and 42, however, is employed in the embodiment of FIGS. 7 through 10. Instead, the tent legs are provided by a pair of sectionalized flexible tent poles 74 and 75, which are of the type commonly employed in lightweight backpacking tents in widespread use throughout the world. These pole sections typically include segments of approximately 12" to 18" in length, with a male end and a receiving end for interconnection together. The sections are sufficiently flexible to assume a curved configuration, such as shown in FIG. 7, for the pole 74. Each of the tent leg holding members 70 has a socket located in it to receive one end of the sectionalized tent poles 74 and 75, as illustrated in FIG. 9. The opposite end is fitted into a fabric sleeve or receptacle 84 (FIG. 10), which is sewn into the tent 30 at the junction of the floor and the upper portion When the tent poles 74 and 75 assume the configuration shown in FIG. 7, the tent fabric 30 is either placed over the poles or is suspended by loops, through which the poles pass to assume the overall configuration illustrated in FIG. 7.

The tent of FIGS. 7 and 8 is self-standing, and does not require any ropes or tent pegs to hold it in place. The backpack assumes essentially the same orientation that it does in conjunction with the embodiment described above in conjunction with FIGS. 1 through 6; and the end of the tent for the embodiment of FIGS. 7 through 10 has the flaps 61, 63 and 65 on it to enclose the backpack in the same manner described previously. As with the embodiment of FIGS. 1 through 6, the embodiment of FIGS. 7 through 10 presents the pack 18 of the backpack to the interior of the tent; so that the contents of all of the pockets in the backpack are readily accessible from the interior of the tent by persons inside the tent.

The foregoing description of the preferred embodiments of the invention is to be considered as illustrative, and not as limiting. Tent pole or frame configurations other than the ones described in the two embodiments will occur to those skilled in the art. Also, the specific configuration of the backpack frame and the pack itself is for purposes of illustration only; and the different embodiments of the invention may be used in conjunction with other backpack frames as well as the one shown and described. Various other changes and modifications will occur to those skilled in the art without departing from the true scope of the invention as defined in the appended claims.

I claim:

1. A backpack and tent system comprising a rigid backpack frame having an upper end and lower end, with first and second spaced-apart side members for carrying a pack thereon, said system further including in combination:

first and second tent leg holding members attached to said first and second side members, respectively, of said backpack frame near the upper end thereof;

an erectable tent member attached to the lower end of said backpack frame for storage and carrying thereon when said tent member is in a non-erected position, said tent member having first and second end flaps for extension around said backpack frame and including means on said first and second end flaps for releaseably securing said end flaps, together to enclose said backpack frame and a pack when mounted thereon inside said tent member when said tent member is erected; and tent leg members extending from said tent leg holding members to maintain said backpack frame in a generally upright position when said tent is erected.

2. The combination according to claim 1 wherein said tent leg members comprise first and second tent leg members for extension, respectively, between said first and second spaced-apart side members on said backpack frame and terminating at a distance spaced from said backpack frame for supporting said tent member in an erected position, with said first and second tent leg members and said backpack frame substantially self-supporting said tent member when said tent member is erected.

3. The combination according to claim 2 wherein said first and second tent leg members comprise elongated flexible tent leg members.

4. The combination according to claim 3 wherein said first and second tent leg members each comprise a plurality of interconnected leg segments.

5. The combination according to claim 4 wherein a pack on said backpack frame is accessible from within said tent member when said tent member is erected.

6. The combination according to claim 5 further including an extension on said tent member secured to the lower end of said backpack frame and dimensioned to cover said tent member when said tent member is rolled up and carried on said backpack frame.

7. The combination according to claim 6 wherein said extension includes means for securing said extension and said rolled up tent member in a storage position on said backpack frame.

8. The combination according to claim 7 wherein said tent member further includes a flap extending over a pack on said backpack frame when said first and second end flaps are releaseably secured together when said tent member is erected.

9. The combination according to claim 1 further including an extension on said tent member secured to the lower end of said backpack frame and dimensioned to cover said tent member when said tent member is rolled up and carried on said backpack frame.

10. The combination according to claim 9 wherein said extension includes means for securing said extension and said rolled up tent member in a storage position on said backpack frame.

11. The combination according to claim 1 wherein a pack on said backpack frame is accessible from within said tent member when said tent member is erected.

12. The combination according to claim 1 wherein said tent backpack frame when said first and second end flaps are releaseably secured together when said tent member is erected.

13. The combination according to claim 1 wherein said tent leg members comprise first and second tent legs, and said tent leg holding members are pivotally attached to said first and second side members, with said first and second tent leg members attached at one end thereof to said tent leg holding members, respectively, for moving from a storage position adjacent said first and second side members of said backpack frame to a position spaced from said side members; so that said backpack frame and said first and second tent legs are self-supported in said generally upright position.

14. The combination according to claim 13 wherein said first and second tent leg members are telescoping legs.

15. The combination according to claim 13 wherein a pack on said backpack frame is accessible from within said tent member when said tent member is erected.

16. The combination according to claim 15 further including an extension on said tent member secured to the lower end of said backpack frame and dimensioned to cover said tent member when said tent member is rolled up and carried on said backpack frame.

17. The combination according to claim 16 wherein said extension includes means for securing said extension and said rolled up tent member in a storage position on said backpack frame.

18. The combination according to claim 17 wherein said tent member further includes a flap extending over a pack on said backpack frame when said first and second end flaps are releaseably secured together when said tent member is erected.

19. The combination according to claim 18 further including additional tent leg means for supporting the portion of said tent spaced from said backpack frame when said tent member is erected.

* * * * *